United States Patent [19]

Aramaki et al.

[11] 4,422,008

[45] Dec. 20, 1983

[54] ELECTRON TUBE HAVING A PHOTOELECTRIC SCREEN

[75] Inventors: Yoshimitsu Aramaki, Kawasaki; Norio Harao, Ayase, both of Japan

[73] Assignee: Tokyo Shibaura Denki Kabushiki Kaisha, Kawasaki, Japan

[21] Appl. No.: 312,981

[22] Filed: Oct. 20, 1981

[30] Foreign Application Priority Data

Oct. 22, 1980 [JP] Japan ..... 55-150615[U]

[51] Int. Cl.[3] ..... H01J 40/00

[52] U.S. Cl. ..... 313/524; 313/523; 313/544; 250/215

[58] Field of Search ..... 313/527, 544, 537, 524; 250/215, 549, 214 AL, 203 CT, 213 NT

[56] References Cited

U.S. PATENT DOCUMENTS 4,331,898 5/1982 Shimizu et al. ..... 313/527

*Primary Examiner*—David K. Moore
*Assistant Examiner*—K. Wieder
*Attorney, Agent, or Firm*—Cushman, Darby & Cushman

[57] ABSTRACT

An electron tube which comprises a metal vacuum envelope, a metal high energy ray input window fitted to the envelope, and photoelectric screen held in the envelope at a point close to the high energy ray input window, and which is characterized in that a semiconductor photosensor is set at that position within the vacuum envelope which lies near the peripheral edge of the photoelectric screen and to which a material constituting the photoelectric screen can be deposited, said photoelectric screen comprising a sealed container provided with a light input window and a semiconductor element received in the container.

6 Claims, 7 Drawing Figures

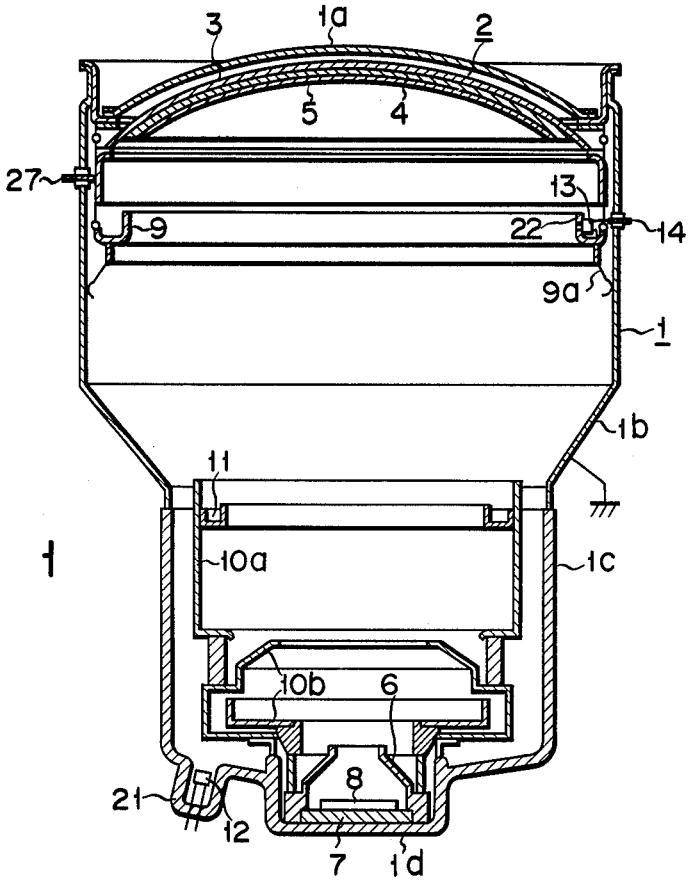
FIG. 1
FIG. 2
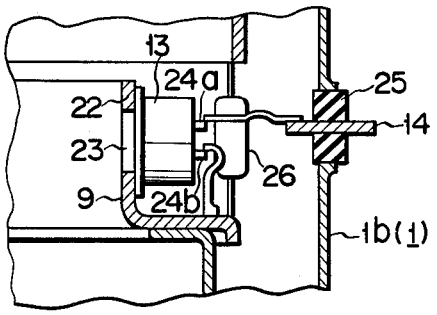
FIG. 3
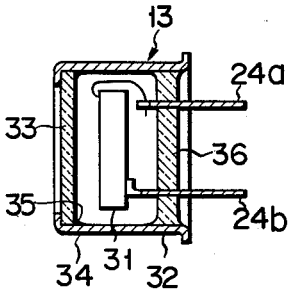

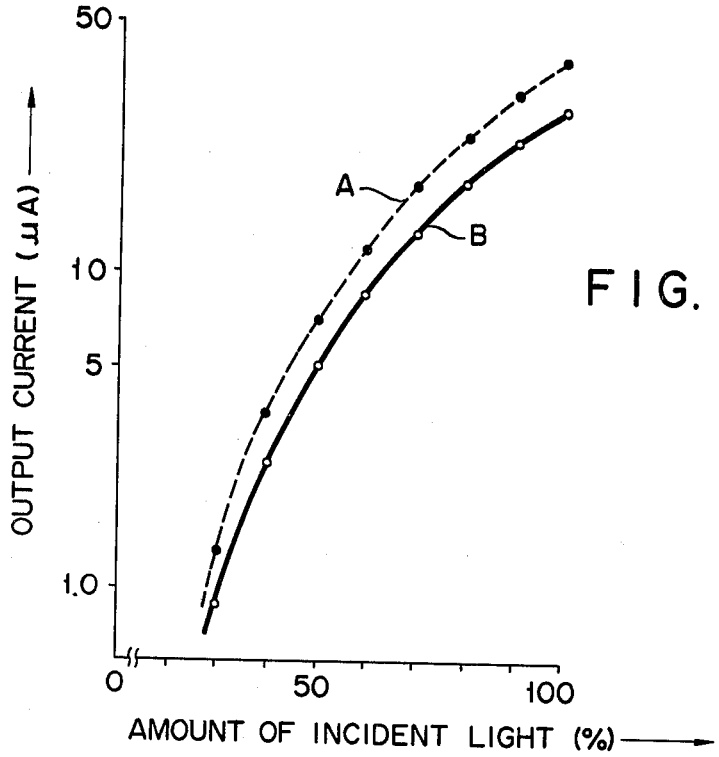
FIG. 4
FIG. 5
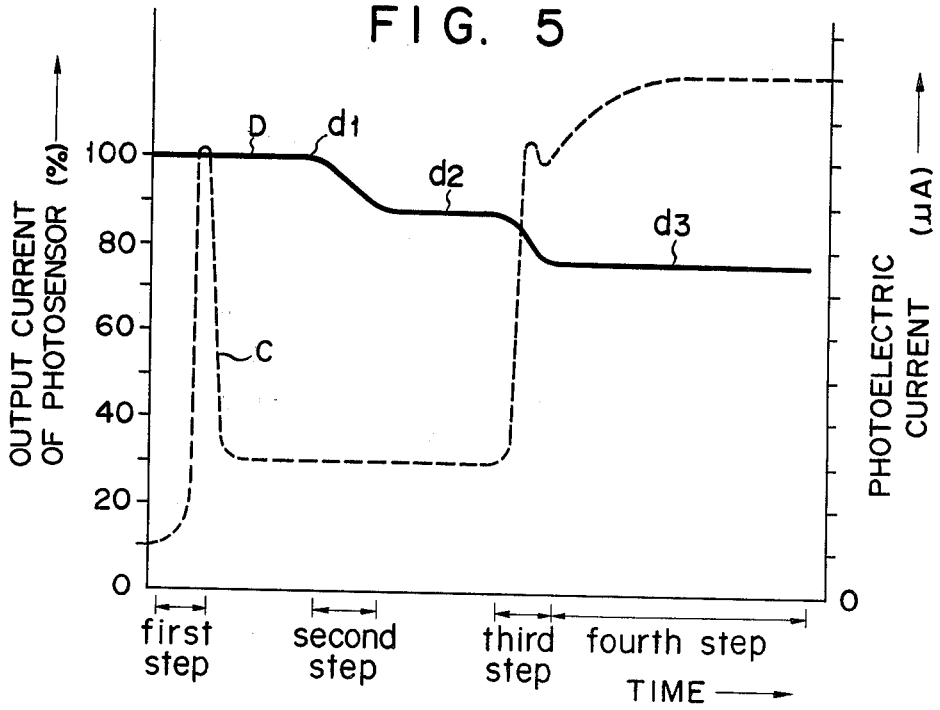

ELECTRON TUBE HAVING A PHOTOELECTRIC SCREEN

BACKGROUND OF THE INVENTION

This invention relates to improvements on an electron tube having a photoelectric screen, such as an X-ray image intensifier.

An electron tube having a photoelectric screen, for example, X-ray image intensifier or gamma ray image intensifier is generally applied to the detection of high energy rays such as X-rays and gamma rays. The input window material of these intensifiers has hitherto been formed of glass. Recently, however, the input window of these intensifiers has come to be formed of a thin metal sheet. The reason is that in view of technical improvement of processing metal and rise in the cost of raw materials, a metal input window will eventually assure lower cost, if consideration is given to the processes and materials involved in the completion of such intensifier. Further, application of a metal input window has led to the tendency of using metal to other parts of the intensifier.

The photoelectric screen is generally prepared from a reaction product of a semimetal such as Sb, Bi or Te and an alkali metal. The method of forming the photoelectric screen is broadly classified into two types from a difference in the vacuum deposition processes. One of said processes comprises holding an alkali metal source and semimetal source in an envelope. For example, Cs and Sb are alternately deposited for mutual reaction on the substrate of an input screen from the corresponding alkali metal source and semimetal source repeatedly, until the photoelectric screen obtains a maximum sensitivity. However, this process has the drawback of presenting difficulties in enabling a photoelectric screen to have a high sensitivity.

Another process comprises initially depositing a prescribed amount of a semimetal, for example, Sb on the substrate of an input screen, and later depositing an alkali metal such as Cs for reaction with said semimetal, thereby to produce a photoelectric screen. If the quantification of Sb can be effected with high reproducibility, then the latter process is effective to produce a photoelectric screen with high sensitivity and stability.

The quantification of Sb applied in the latter process has hitherto been carried out in the following manner. A photoelectric tube is set near a photoelectric screen and outside of that portion of an envelope, to the inner wall of which Sb can be deposited. A light source is provided on that side of an X-ray image intensifier which is opposite to that thereof which faces a photoelectric tube. The quantification of Sb has hitherto been effected by reading the extent to which photoelectric current flowing in the photoelectric tube varies with an amount of Sb deposited on the inner wall of the envelope. However, the conventional quantification process of Sb has the undermentioned drawback that said quantification process is subject to heavy limitation depending on the structure of an image intensifier.

Recently, the internal structure of that type of an electron tube having a photoelectric screen in which electron beams are focused by an electric field is increasingly complicated due to the demand for the high performance of the electron tube. Referring to, for example, an X-ray image intensifier, the conventional type comprising three electrodes has been changed into the type which is provided with four electrodes in order to make a view field variable, or into the type which is formed of five electrodes in order to improve the distribution of resolution. Thus, the recent trend of an electron tube goes toward the type having an increasing number of electrodes. With an X-ray image intensifier having the above-mentioned inner structure, the passage of a light emitted from a light source is obstructed by a plurality of electrodes held in said intensifier, making it impossible to adopt the Sb quantification process.

Further, an attempt to prepare an input window material and other parts of an envelope from metal has come to be more widely accepted in order to reduce the scattering of a light in input window of the X-ray image intensifier and decrease the material cost and work cost. With the X-ray image intensifier provided with a metal envelope, it is obviously impossible to adopt the aforementioned quantification process of Sb.

SUMMARY OF THE INVENTION

This invention has been accomplished in view of the aforesaid circumstances and is intended to provide an electron tube having a photoelectric screen whose structure is adapted to assure the formation of the photoelectric screen having a desired stable photoelectric sensitivity.

Another object is to provide a method of manufacturing said photoelectric screen.

To attain the above-mentioned object, this invention provides an electron tube which comprises:

a metal vacuum envelope;

a metal high-energy ray input window fitted to the envelope; and a photoelectric screen set close to the metal high-energy ray input window and formed in the envelope, and which is characterized in that a semiconductor photosensor is set at that position in the metal vacuum envelope which is close to the peripheral edge of the photoelectric screen and to which a material constituting the photoelectric screen can be deposited, said semiconductor photosensor comprising a sealed container provided with a light input window and a semiconductor element held in said container.

This invention further provides a method of manufacturing the photoelectric screen of the electron tube, which comprises the steps of:

setting a semiconductor photosensor comprising a sealed container having a light input window and a semiconductor element held in said container at that position within the metal vacuum envelope which is close to the peripheral edge of the photoelectric screen and to which semimetal can be deposited, said envelope holding an input screen substrate, alkali metal evaporation source and semimetal evaporation source;

evaporating alkali metal from the alkali metal source until a maximum photoelectric current is produced from the input screen substrate on which the evaporated alkali metal is deposited;

evaporating semimetal from the semimetal source until an output current from the semiconductor photosensor reaches a prescribed level of voltage; and again evaporating the alkali metal from the alkali metal source until a photoelectric current having a maximum level is delivered from the input screen substrate on which the alkali metal and semimetal are deposited, thereby forming a photoelectric screen on the surface of the input screen substrate.

BRIEF DESCRIPTION OF THE DRAWING

FIG. 1 is a schematic cross sectional view of an X-ray image intensifier according to one embodiment of this invention;

FIG. 2 is an enlarged cross sectional view of the main part of the X-ray image intensifier of FIG. 1;

FIG. 3 is a cross sectional view of a semiconductor photosensor used with an electron tube embodying this invention;

FIG. 4 is a curve diagram showing the property of the semiconductor photosensor of FIG. 3;

FIG. 5 graphically indicates the changes in an output current delivered from the semiconductor photosensor and an output current issued from the photoelectric screen which occur during the step of forming a photoelectric screen embodying the invention.

DETAILED DESCRIPTION OF THE PREFERRED EMBODIMENTS

Figure 6:
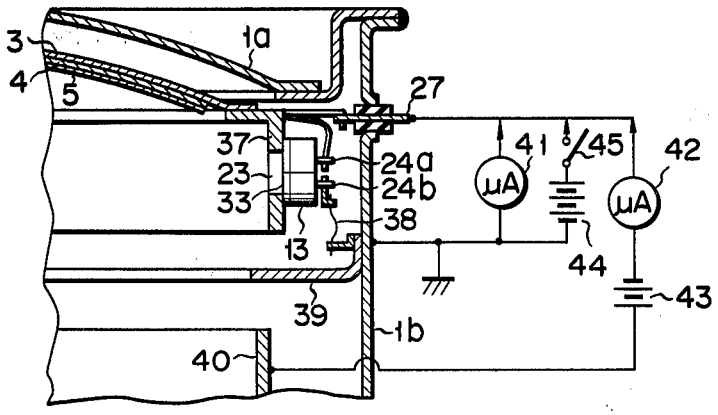
FIGS. 6 and 7 are cross sectional view of the main part of an X-ray image intensifier according to other embodiments of the invention.

Description is now given with reference to the accompanying drawing of an electron tube embodying this invention. Reference is made to an X-ray image intensifier. An X-ray image intensifier embodying the invention is arranged as shown in FIGS. 1 and 2. A vacuum envelope 1 comprises an aluminum input window 1*a*, stainless steel body 1*b*, glass body 1*c* and glass output window 1*d*. An input screen 2 is set inside of the input window 1*a*. This input screen 2 comprises an input phosphor screen formed on a spherical aluminum substrate 3 and a photoelectric screen 5 deposited on said input phosphor screen 4. An anode 6 is provided inside of the output side of the envelope 1. An output photoelectric screen 8 is formed on an output substrate 7. A first grid electrode 9 extends along the inner lateral wall of the vacuum envelope 1 to be electrically connected to the stainless body 1*b*. A second grid electrode 10*a* and third grid electrode 10*b* are arranged on that side of the vacuum envelope 1 in which the anode 6 is set, in the order mentioned as counted from the input side of the vacuum envelope 1. An alkali metal source is provided in a cavity 11 of the second grid electrode 10*a*. A projection 21 is formed in the rear part of the glass body 1*c* of the vacuum envelope 1. A boat 12 allowing for the evaporation of a semimetal such as antimony is held in the projection 21.

A semiconductor photosensor 13 such as a photodiode is set in that portion of, for example, the first grid electrode 9 in which the electric field thereof is not considerably disturbed. A terminal 14 required for the actuation of said semiconductor photosensor 13 projects therefrom to the outside of the vacuum envelope 1. A through hole 23 is formed in part of a cylindrical wall 22 of the first grid electrode 9 substantially as large as the light input window of the semiconductor photosensor 13. The photosensor 13 is fixed outside of said through hole 23. One 24*a* of a paired signal output terminals of the photosensor 13 is connected to a terminal 14 through a lead. Said terminal 14 penetrates the metal body 1*b* of the vacuum vessel 1 in airtightness by passing through an insulating member 25. The other signal output terminal 24*b* is connected to the first grid electrode 9 electrically short circuited to the metal body 1*b*. In operation, the first grid electrode 9 is short circuited to the metal body 1*b* through a conductive spring 9*a*, causing both members 9, 1*b* to have a ground potential. Referring to FIGS. 1 and 2, reference numeral 26 denotes a spacer for electrically separating the input screen 2 from the first grid electrode 9. Reference numeral 27 represents a lead terminal of the input screen 2.

With an electron tube embodying this invention, it is possible to control an amount of a semimetal such as antimoty deposited on the outside of the light input window of the semiconductor photosensor 13 by detecting the voltage level of an output signal from the semiconductor photosensor 13 which varies with the deposited amount of said semimetal by utilizing a small amount of a light entering the vacuum envelope 1 through its glass body 1*c*. The semiconductor photosensor 13 which is set near the photoelectric screen 5 can detect the deposited amount of a semimetal very accurately. Where an X-ray image intensifier has such a structure as prevents a light from being introduced thereinto from outside of the vacuum envelope 1 or allows the entry of only an extremely small amount of a light, then a small light source can be set at a suitable spot within the vacuum envelope 1. Further, it is possible to provide a plurality of semiconductor photosensor 13 near the outer periphery of the photoelectric screen 5. This arrangement can detect the degree of uniformity with which a semimetal is deposited over the whole region of the photoelectric screen 5. Further, the semiconductor photosensor 13 may be fitted to the inner wall of a metal envelope.

When the aforementioned semiconductor silicon photodiode is exposed to heat applied to the evacuation of a vacuum tube such as an X-ray image intensifier or the formation of a photoelectric screen, the property of said silicon photodiode deteriorates. With an electron tube manufacturing method embodying this invention, however, during the manufacture of an X-ray image intensifier, that portion thereof to which the silicon photodiode is fitted is not heated to an extremely high temperature as over 300° C. Therefore, the silicon photodiode can fully withstand practical application with respect to the photoelectric screen manufacturing method of the invention. Rather, application of the silicon photodiode assures the far higher reproducibility of the Sb quantification than has been possible with the prior art method. Further, application of said silicon photodiode has made it possible to use a metal envelope having such a structure as substantially shuts off the introduction of any external light. An X-ray image intensifier embodying this invention is evacuated for seven hours in a furnace maintained at a temperature of 250° C. Therefore, a silicon photodiode used in the manufacture of the X-ray image intensifier should obviously withstand such temperature. In recent years, a novel type of photodiode has been developed which is constructed by sealing silicon element in a metal case by means of a vitreous solvent. Such silicon photodiode well matches the object of this invention.

FIG. 3 indicates the arrangement of a silicon photodiode which is applicable to attain the object of this invention. A semiconductor photosensor 13 formed of said photodiode is constructed by sealing a silicon element 31 having a PN junction in an airtight vessel 32 and drawing out an electrode to the outside by means of a pair of leads 24*a*, 24*b*. The airtight vessel 32 is constructed by airtightly connecting together a glass light input window 33 and metal case 34 by means of a fritted glass seal section 35, and airtightly sealing the leads 24*a*, 24*b* and metal case 34 by a fritted glass stem 36. The airtight vessel 32 is filled with an oxidation-preventing gas such as $N_2$. This type of airtightly sealed photodiode is now widely marketed. For the object of this invention, care should be taken to select such type of airtightly sealed vessel whose airtightness is not destroyed even when said vessel is heated to about 300° C. However, the upper limit temperature at which the airtightly sealed photodiode can be applied is generally set at about 125° C. from the standpoint of assuring the electric property of said photodiode. The present inventors made comparison between the electric properties of such photodiode before and after said photodiode was held at a high temperature of 250° C. for 7 hours in vacuum, the condition which is generally regarded as a guide for the evacuation of an X-ray image intensifier, the results being set forth in FIG. 4. In FIG. 4, an amount (relative to the initial value) of an incident light is shown on the abscissa, and an output current from the photodiode is indicated on the ordinate. Dotted line curve A denotes the initial electric property of said photodiode, and solid line curve B represents the electric property of the photodiode after the X-ray image intensifier was evacuated. The above-mentioned experiments proved that the output characteristic or sensitivity characteristic of the photodiode dropped about 30% after the electron tube was evacuated at 250° C. for 7 hours, but that relationship between the amount of an incident light and the magnitude of an output current from the photodiode little changed. Therefore, it has been confirmed that the relative sensitivity characteristic of the photodiode is practically effective in controlling the quantification of a semimetal such as antimony during the step of forming a photoelectric screen.

Description is now given with reference to FIG. 5 of the step of forming a photoelectric screen after the above-mentioned evacuation of the electron tube. In the first step, an alkali metal such as cesium is continuously evaporated until a photoelectric current (dotted line curve C) reaches a maximum level. At this time, since alkali metal is substantially transparent, an output current of a semiconductor photosensor hardly varies. In the second step a semimetal such as antimony is evaporated, until an output current of the semiconductor photosensor attains a prescribed level d2 relative to the initial value d1 as indicated by a solid line D. In the case of an X-ray image intensifier using a CsI phosphor, the above-mentioned prescribed level d2 is found to have an optimum value within the range of about 70 to 90% of the initial value d1. In the third step, the alkali metal such as cesium is again evaporated. During the third step, the alkali metal forms a compound with the previously deposited antimony, rapidly increasing an output photoelectric current C from the photoelectric screen. Where said increased photoelectric current C shows a maximum value, then the evaporation of the alkali metal is brought to an end. At this time, an output current from the semiconductor photosensor drops to a level d3. Throughout the first to the third steps, the ambient temperature of the X-ray image intensifier is chosen to fall within the range of 80° to 120° C. In a fourth step, the X-ray image intensifier is slowly cooled down to room temperature. During this step, an output photoelectric current C from the photoelectric screen is further increased until it finally reaches a stable value. Where a photoelectric screen is formed of a compound obtained by evaporation of an alkali metal and antimony, it is important to control the quantification of deposited antimony in particular. To this end, the photoelectric screen manufacturing method of the present invention detects an output current from the semiconductor photosensor relative to the initial value, thereby elevating the reproducibility of the quantification of deposited antimony. The conventional process of controlling the quantification of Sb is not applicable, to the case where those portions of an evacuated envelope which surround the photoelectric screen, and X-ray input window are formed of metal. In contrast, the electron tube embodying this invention in which a semiconductor photosensor is held in the envelope enables the quantification of deposited Sb to be reliably controlled with great ease.

With an X-ray image intensifier according to another embodiment of this invention, a through hole 23 is formed in part of an annular photocathode support 37 which has an L-shaped cross section and supports a photoelectric screen 5, fluorescent screen 4 and substrate 3, and a semiconductor photosensor 13 is fitted to the backside of said photocathode support. The semiconductor photosensor 13 is set in place with its light input window 33 made to face the through hole 23. One 24*a* of a pair of leads of the photosensor 13 is electrically connected to a support 37 concurrently acting as an electrode of the photoelectric screen 5 and also to a terminal 27 for drawing out said support 37 to the outside. The other lead 24*b* of the photosensor 13 is electrically connected to a first grid electrode integrally formed with the metal body 1*b* through a readily melting fuse 38. A second grid electrode 40 is provided below said first grid electrode 39. The embodiment of FIG. 6 is freed of an output terminal (indicated by reference numeral 14 in FIGS. 1 and 2) of the semiconductor photosensor 13. The terminal of said photosensor 13 is connected to an internal grid electrode to which said photosensor 13 is fitted. The external terminal of said internal electrode is concurrently used as an external terminal of the photosensor 13. The above-mentioned arrangement of FIG. 6 offers convenience, because it is unnecessary to fit an extra airtight electrode terminal to the metal body 1*b* of the envelope 1.

With an electron tube constructed according to the embodiment of FIG. 6, an output current from the semiconductor photosensor 13 is detected by an ammeter 41 connected between the external terminal 27 of a photoelectric cathode and the grounded metal body 1*b* of the envelope 1. An output photoelectric current from the photoelectric screen 5 is detected by an ammeter 42 and D.C. source 43 connected between the external terminal 27 of the photoelectric cathode and second grid electrode 40. Where the semiconductor photosensor 13 used in the formation of the photoelectric screen 5 has become unnecessary, the fuse 38 is melted away by introducing a large current therethrough. A power source 44 and switch 45 are provided to effect the melting of said fuse 38. Finally, all the electrodes held in the electron tube are respectively supplied with a prescribed level of operation potential.

Figure 7:
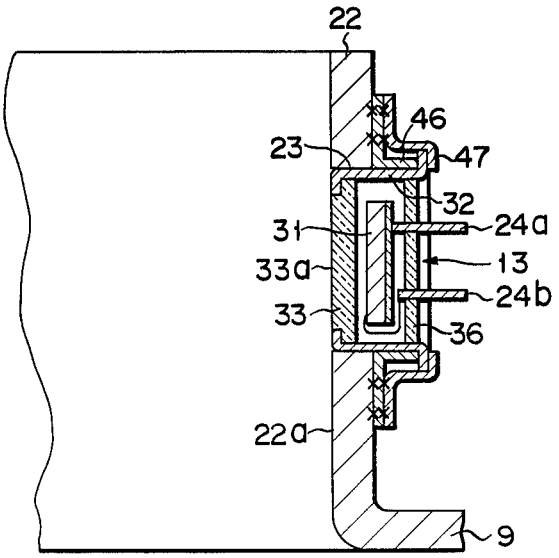

Description is now given with reference to FIG. 7 of an electron tube according to still another embodiment of this invention. The electron tube arranged as shown in FIG. 7 is the type, in which even the fitting of a semiconductor photosensor is not likely to disturb an electric field produced by the internal electrode. Namely, with the embodiment of FIG. 7, the outer surface 33*a* of the light input window 33 of the semiconductor photosensor 13 is so fitted as to be substantially flush with the inner surface (*22a*) of the cylindrical wall 22 of the internal electrode 9 by fitting the semiconductor photosensor 13 into the through hole 23 formed in the internal electrode 9. Reference numerals 46, 47 given in FIG. 7 are metal parts for securely positioning the semiconductor photosensor 13. Said metal parts 46, 47 are respectively welded in the positions marked by a mark x.

With the embodiment of FIG. 7, the light input window of the semiconductor photosensor 13 is formed of an insulating material, for example, glass. Where evaporated antimony are deposited on the surface of said glass insulating plate, then a conductive layer is formed on the surface of said insulating material. This conductive layer is electrically connected to the internal electrode 9 through a metal vessel 32. Electrically, therefore, the inner wall of the internal electrode 9 is practically rendered equivalent to the case where the through hole 23 is actually closed, thereby keeping an electric field prevailing in the proximity of the inner wall of said internal electrode 9 little disturbed, and consequently offering the advantage of preventing the picture quality of an image from being deteriorated.

An electron tube embodying this invention which is constructed as previously described and arranged as shown in the accompanying drawing offers the following prominent advantages. Insertion of a semiconductor photosensor into an electron tube manufactured by high temperature treatment has hitherto never been thought of in view of the electric property of said photosensor. However, this invention has proved that the insertion of a semiconductor photosensor into an electron tube can be effected. Further, the invention has made it possible to control the quantification of a deposited semimetal with high precision. Consequently, the invention has made a process of forming a photoelectric screen with high sensitivity applicable even to an X-ray image intensifier which is provided with an increasing number of grid electrodes in order to attain high performance and comprises a metal vessel.

Throughout the foregoing embodiments, reference was made to the case where the semiconductor photosensor 13 was formed of a photodiode. However, this invention is not limited to said case. For instance, even a semiconductor photosensor formed of a phototransistor or CdS photosensor offers the same effect as the aforementioned photodiode.

Further, the aforementioned embodiments cited the application of an X-ray image intensifier as an electron tube. However, the concept of the invention is widely applicable to a gamma ray—detecting image intensifier and other electron tubes provided with a photoelectric screen.

What we claim is:

1. An electron tube which comprises:

a metal vacuum envelope;

a metal high energy ray input window fitted to the envelope; and a photoelectric screen held in the metal vacuum envelope in the proximity of the high energy ray input window, and is characterized in that a semiconductor photosensor is set at that position within the metal vacuum envelope which lies near the peripheral edge of the photoelectric screen and to which a material constituting the photoelectric screen can be deposited, said semiconductor photosensor being formed of a sealed container provided with a light input window and a semiconductor element received in the container.

2. The electron tube according to claim 1, wherein the semiconductor photosensor is one selected from the group consisting of a photodiode, phototransistor and CdS photosensor.

3. The electron tube according to claim 1, wherein a plurality of grid electrodes are held in the envelope; and the semiconductor photosensor is fitted to one of the plural grid electrodes which is connected to the envelope and lies at a position closest to the photoelectric screen.

4. The electron tube according to claim 3, wherein the semiconductor photosensor is provided with a pair of signal output terminals, one of which is connected to a lead which penetrates the envelope airtightly through an insulating material and is drawn out to the outside, and the other of which is connected to that of the grid electrode to which the semiconductor photosensor is fitted.

5. The electron tube according to claim 1, wherein the photoelectric screen is mounted on the surface of a phosphor screen formed on an input screen substrate; the peripheral edge of the input screen substrate is supported by a circular photocathode support which has an L-shaped cross section and is connected to a lead airtightly penetrating the envelope through an insulating material to be drawn out to the outside; and the semiconductor photosensor is fitted to the circular photocathode support.

6. The electron tube according to claim 5, wherein the semiconductor photosensor is provided with a pair of signal output terminals, one of which is connected to the photocathode support.

* * * * *